United States Patent [19]

Finn et al.

[11] Patent Number: 4,938,132

[45] Date of Patent: Jul. 3, 1990

[54] HAND OPERATED IMPRINTER APPARATUS

[75] Inventors: John P. Finn; Raymond Kenny, both of Blanchardstown; Cornelius B. Clarke, Raheny; Patrick J. Lawlor, Dublin, all of Ireland

[73] Assignee: Security Imprinter Corporation, Walkersville, Md.

[21] Appl. No.: 51,572

[22] Filed: May 18, 1987

Related U.S. Application Data

[63] Continuation-in-part of Ser. No. 833,601, Feb. 27, 1986, abandoned.

[30] Foreign Application Priority Data

Nov. 18, 1985 [IE] Ireland ..... 2885/85

[51] Int. Cl.[5] ..... B41F 3/04

[52] U.S. Cl. ..... 101/269

[58] Field of Search ..... 101/269, 268, 369, 282

[56] References Cited

U.S. PATENT DOCUMENTS

| | | | |
|---|---|---|---|
| 3,260,199 | 7/1966 | Huntley et al. | 101/269 |
| 3,704,668 | 12/1972 | St. Onge et al. . | |
| 3,739,716 | 6/1973 | Barbour | 101/269 |
| 3,763,777 | 10/1973 | Brown | 101/269 |
| 3,780,669 | 12/1973 | Geiger et al. | 101/269 |
| 3,810,424 | 5/1974 | Barbour | 101/269 |
| 3,954,056 | 5/1976 | Barbour | 101/269 |
| 4,270,453 | 6/1981 | Strohschneider | 101/269 |
| 4,457,228 | 7/1984 | Wittek . | |

FOREIGN PATENT DOCUMENTS

| | | |
|---|---|---|
| 866834 | 5/1961 | United Kingdom . |
| 1063438 | 3/1967 | United Kingdom . |
| 1081530 | 8/1967 | United Kingdom . |
| 1509585 | 5/1978 | United Kingdom . |
| 2141795 | 1/1985 | United Kingdom . |

*Primary Examiner*—Eugene H. Eickholt

*Attorney, Agent, or Firm*—Mason, Fenwick & Lawrence

[57] ABSTRACT

A hand operated imprinter for imprinting using a credit card, onto a document, comprising a base member having a panel forming a document supporting surface, a reciprocative roller carrier member transversely spanning the base member and movable longitudinally over the document supporting panel of, the carrier member having opposite side portions flanking opposite sides of the base member, the roller engaging a document when positioned on the panel overlying the base member having tracks at opposite sides of the base member longitudinally spanning the length of the base member for movably supporting and guiding the carrier member the track having a first horizontal track surface paralleling the panel and an inclined downwardly and outwardly facing second track surface having outwardly diverging upper and lower side faces, the portion of said base member at each side thereof lying between said first and second track surfaces defining a truncated triangular rib formation, and said carrier member having a pair of pinched action bearing roller assemblies at the respective opposite side portion.

8 Claims, 10 Drawing Sheets

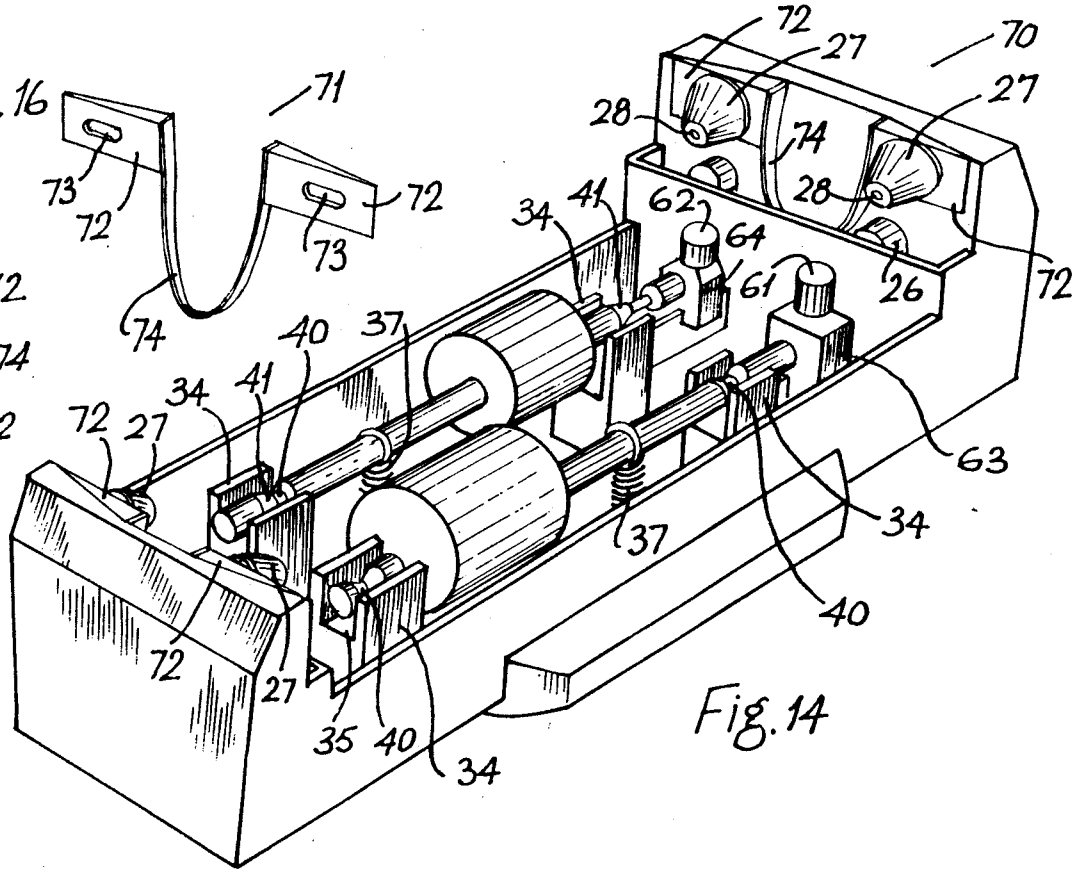
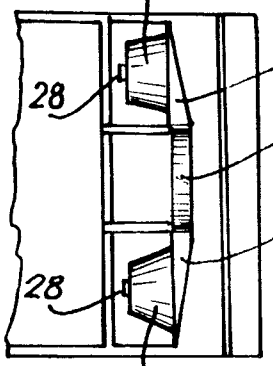
Fig. 15

HAND OPERATED IMPRINTER APPARATUS

BACKGROUND AND OBJECTS OF THE INVENTION

This application is a continuation in part of U.S. Ser. No. 833,607, filed 2-22-86 and now abandoned.

The invention relates to a hand operated imprinter for imprinting characters from a character source member such as a credit card onto a document of the type, and more particularly to a imprinter having a base member having means for receiving a character source member and means for receiving a document, and a carrier supporting imprinting means to press the document against the character source member, the carrier being slidably movable over the base member on a track means provided on the base member.

The invention is characterized in that the carrier includes a pair of spaced-apart bearing means which engage opposing faces of the track means with a pinch action. One advantage of the invention is that by virtue of the fact that the bearing means engages the track with a pinch action a particularly smooth movement of the carrier over the base member is achieved. In one embodiment of the invention the track means comprises a pair of elongated track members on opposite sides of the base member, each track member having outwardly directed track faces. This arrangement provides smooth movement over the length of travel of the carrier.

In a particularly preferred embodiment of the invention the bearing means comprises bearing rollers engaging opposite track faces of the track means with a pinch action embracing the track faces therebetween. The rollers assist in providing a smooth movement of the carrier across the base. Preferably the track faces comprise an upper track face and a lower track face, the lower track face being inclined at an angle to the upper track face, and one of the bearing rollers is a tapered roller to engage the inclined track face. This arrangement provides a particularly smooth action and by virtue of the fact that the lower track face and roller are tapered facilitates adjustment of the pinch action.

In one embodiment of the invention the bearing means comprises at least one pair of pinch rollers, namely an upper pinch roller and a lower pinch roller, at opposite sides of the carrier member located outwardly of and bearing inwardly against the track means. Preferably two pairs of pinch rollers are provided to engage the track means. This assists in balancing the carrier member and in providing a smooth operation. Typically the lower pinch rollers are of tapered inwardly convergent conical configuration. The advantage of this type of roller is that it provides a particularly good pinch action and smooth operation while allowing adjustment for maintaining pinch action as the rollers and/or track faces become worn.

In a particularly preferred embodiment of the invention the means for receiving a document comprises a flat upwardly facing panel forming a document supporting surface. In this embodiment, the document supporting panel and the track means are an integral plastic body having the track means formed therein. The integral plastic construction facilitates ease and cheapness of manufacture and assembly and provides an imprinter of robust construction.

Preferably the carrier member is a reciprocative carrier member transversely spanning the base member and movable longitudinally over the document supporting panel from a start position adjacent one end of the panel to a reversing return position adjacent the other end of the panel, the imprinter roller means comprising at least one imprinter roller for engaging a document when positioned on the panel overlying a character source member during movement of the carrier member between the start and return positions. The base member and carrier member include co-operating means for moving the imprinter roller from a raised inactive position to a lowered imprinting position engaging the document to imprint characters from a character source member onto a document during movement of the carrier member between the start and return position. The imprinter roller may be mounted on a stepped diameter shaft, the shaft being mounted in shaft support members of the carrier member in which the shaft is slidable axially to raise and lower the imprinter roller between print and non-print positions so that the imprinter roller prints in only one direction of travel of the carrier member.

Preferably the co-operating means described in the preceding paragraph comprise cam follower members on the carrier member for axially shifting the shaft and cam abutment formations positioned on the base member to engage the cam follower members at the return and start positions of the carrier member to activate the cam follower members to move the shaft. The roller means may comprise two imprinter rollers for selectively engaging a document, one of the rollers engaging the document during movement of the carrier in one direction and the other of the rollers engaging the document during movement of the carrier in the other direction. The particular advantage of this arrangement is that good quality printing is achieved of the characters from both a credit card and merchants plate. Often the characters on these two sources are worn to varying degrees so that a single pass with a roller gives weak print from one or other source.

In one embodiment of the invention a single cam abutment is provided and link means are provided between the cam followers for movement of both shafts when one of the cam followers engages the cam abutment. The advantage of providing a single cam abutment instead of two abutments is that this reduces the height that the abutment surfaces project from the base and hence the overall height is decreased. In another embodiment of the invention a pair of cam abutments are provided, one to engage each follower of each shaft.

Preferably stop means are provided at each end of the track means to retain the carrier on the track, each of the stop means being formed by a handle and one of the handles being releasably mounted on the base. The advantage in having one of the handles removable is that the carrier may then be easily removed for maintenance. The base member may include an inclined skirt portion for receiving an advertising indica, logo or decals.

Also adjustment means may be provided for varying the gripping pressure with which the bearing grip the track means. This arrangement allow the pinch pressure to be adjusted to accommodate wear of the rollers and/or track faces.

BRIEF DESCRIPTION OF THE FIGURES

The invention will be more clearly understood from the following description of an embodiment thereof, given by way of example only, with reference to the accompanying drawings, in which:

FIG. 14 is a perspective view of a carrier of another imprinter according to the invention;

FIG. 15 is a plan view of a detail of the carrier of FIG. 14; and

FIG. 16 is a perspective view of a detail of the carrier of FIG. 14.

DETAILED DESCRIPTION OF PREFERRED EMBODIMENTS

Figure 1:
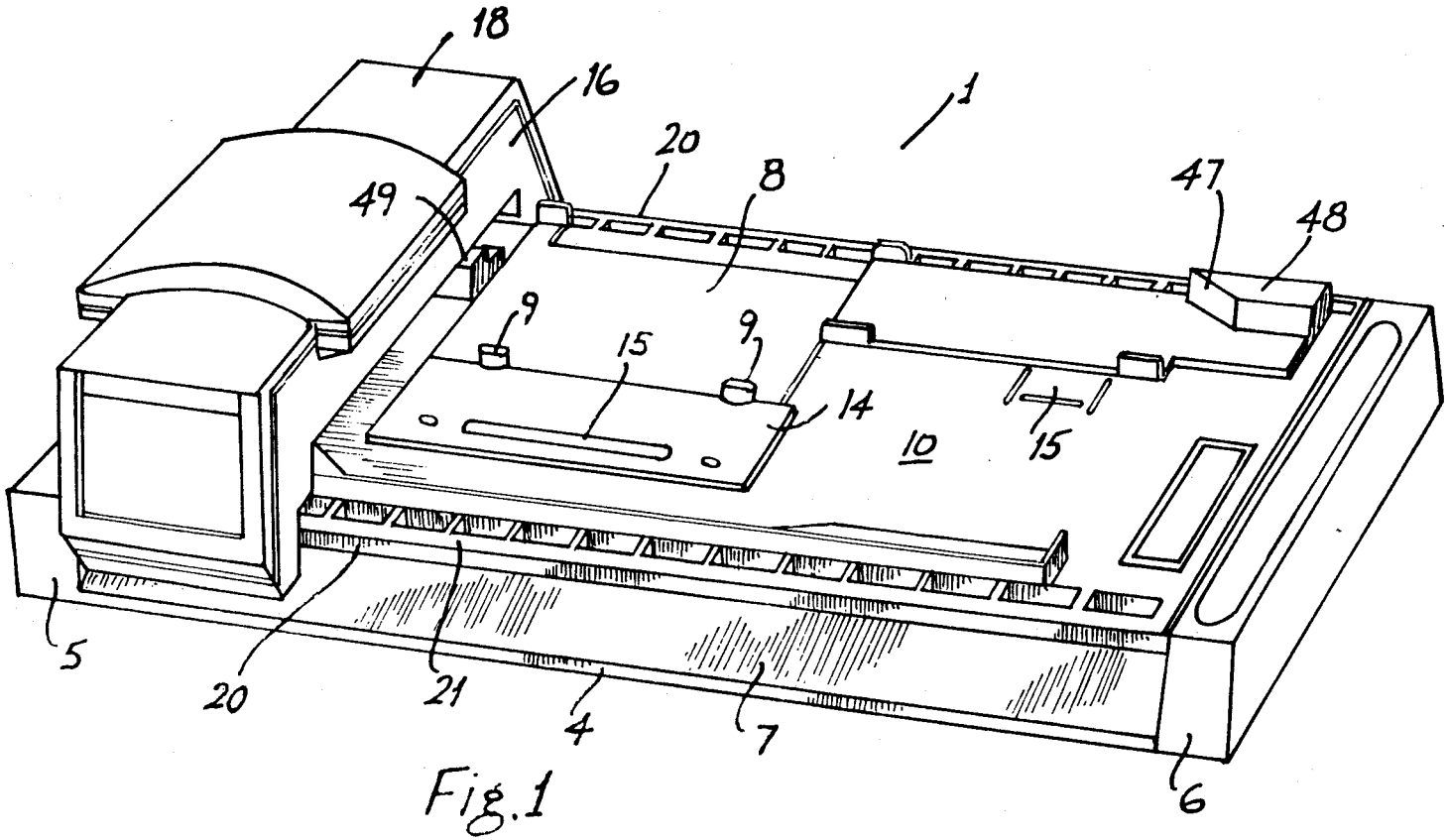
FIG. 1 is a perspective view of an imprinter according to the invention.
Figure 2:
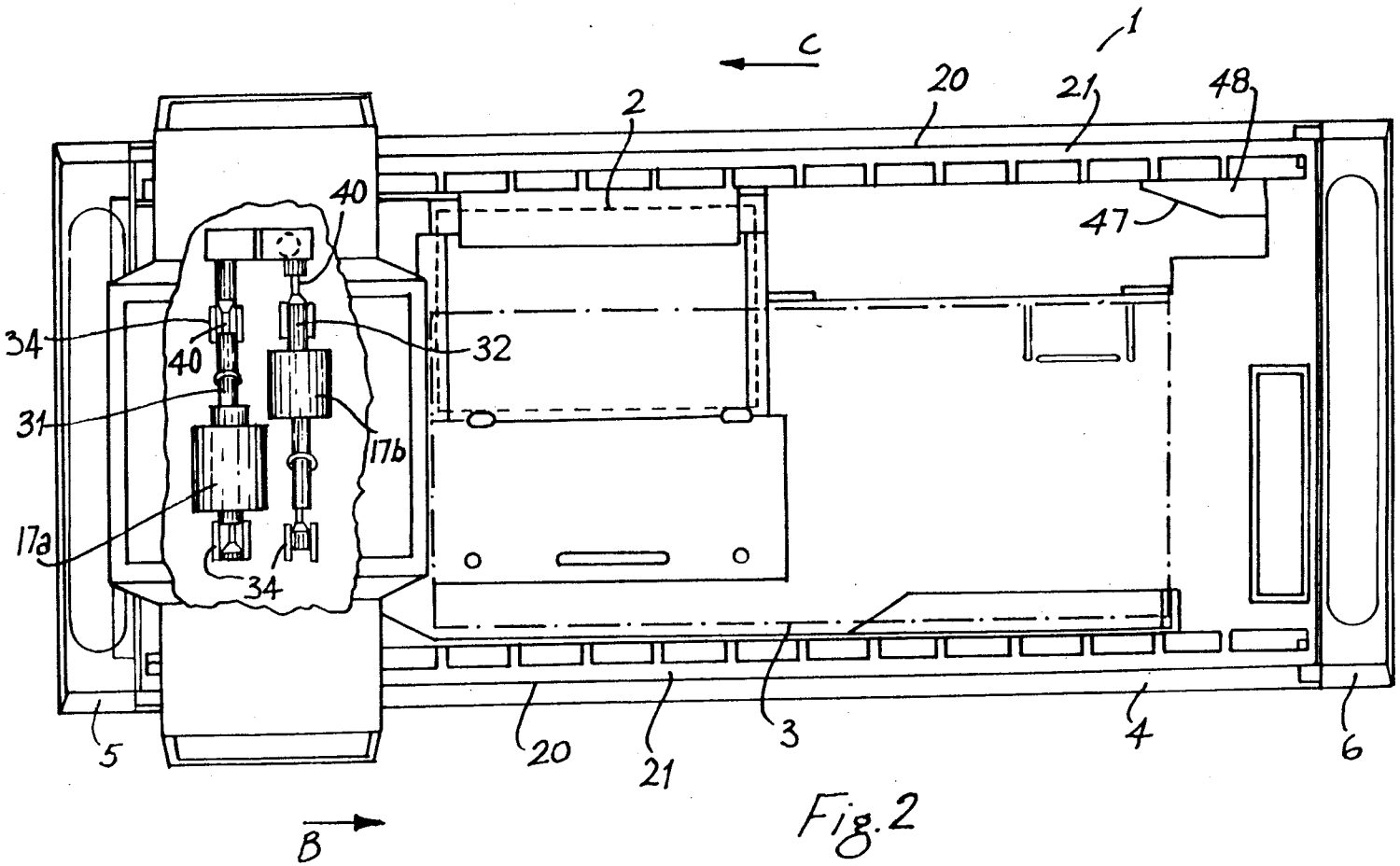
FIG. 2 is a plan view of the imprinter of FIG. 1.
Figure 3:
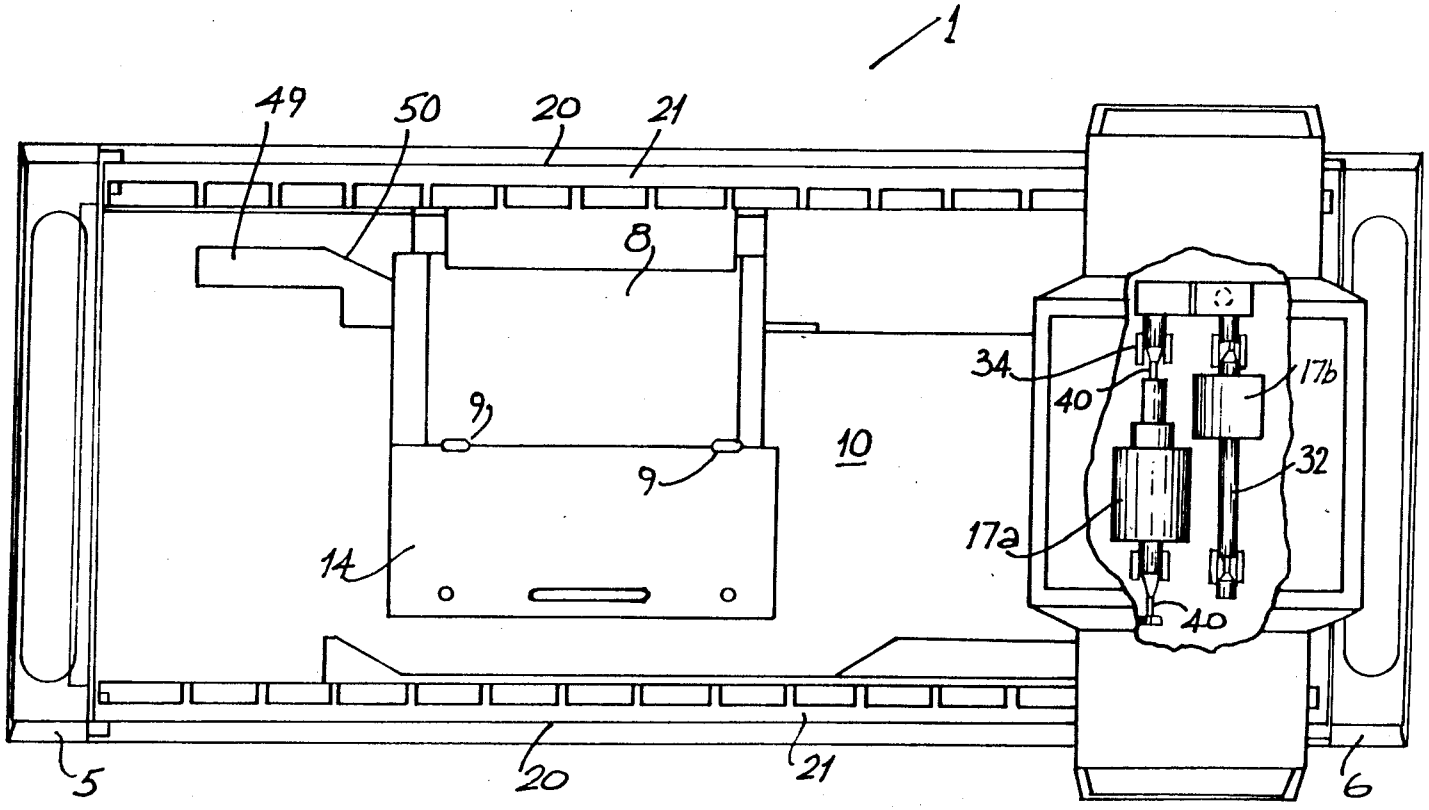
FIG. 3 is a plan view of the imprinter of FIG. 1 with the carrier at the end of its advance stroke.

Referring to the drawings, and initially to FIGS. 1 to 11 there is illustrated an imprinter apparatus according to the invention, indicated generally by the reference numberal 1. In this case, the imprinter apparatus is for imprinting embossed characters from a character source member such as a credit card 2 onto a document such as a document 3. The apparatus 1 is manually operated and comprises a base 4 of injection molded plastics material with a pair of handles 5 and 6 at both ends. The handle 6 is integrally molded with the base 4, and the handle 5 is removable as will be described in more detail below. The base 4 includes an inclined skirt portion 7 for receiving an advertising indica, logo or decals. A receiving means, in this case a receiving area 8 to receive a credit card 2 indicated by broken lines in FIG. 2, is molded into the base 4. A pair of biasing posts or guide stops 9 extend upwardly from the base and bias the card 2 into the receiving area 8. The posts 9 may be spring loaded to allow the posts to be readily depressed. Means to receive a document 3 illustrated by broken lines in FIG. 2, is provided by a flat upwardly facing panel 10 forming part of and integrally molded with the base 4. A merchant's plate 14 with the merchant's details is mounted in the base 4, and a dating mechanism may be mounted in the base 4 for imprinting the date onto the document. Two alternative locations 15 for the dating mechanism are illustrated in FIGS. 1 to 3.

Figure 5:
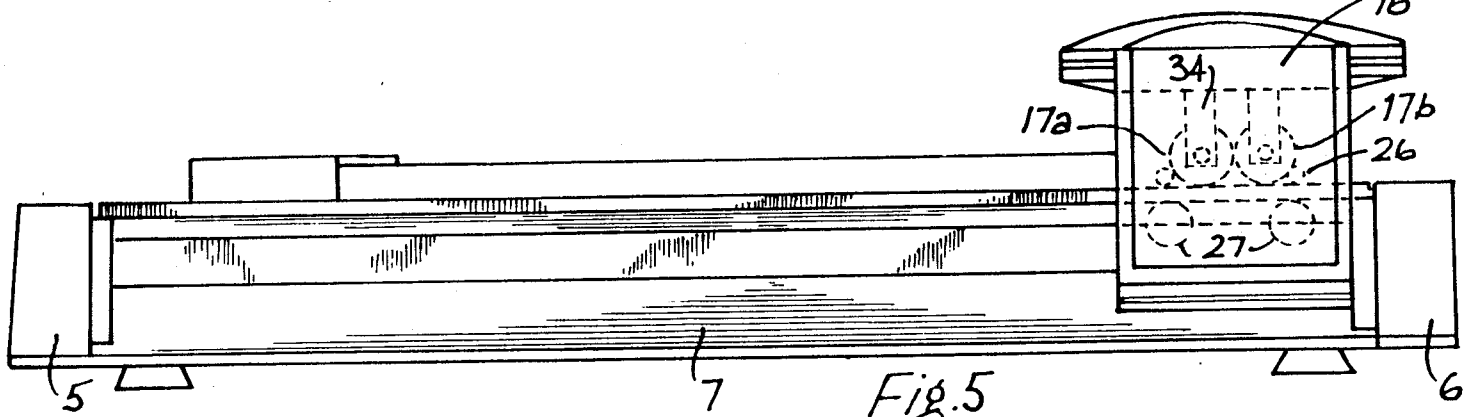
FIG. 5 is a side elevational view of the imprinter with the carriage in the position of FIG. 3.
Figure 4:
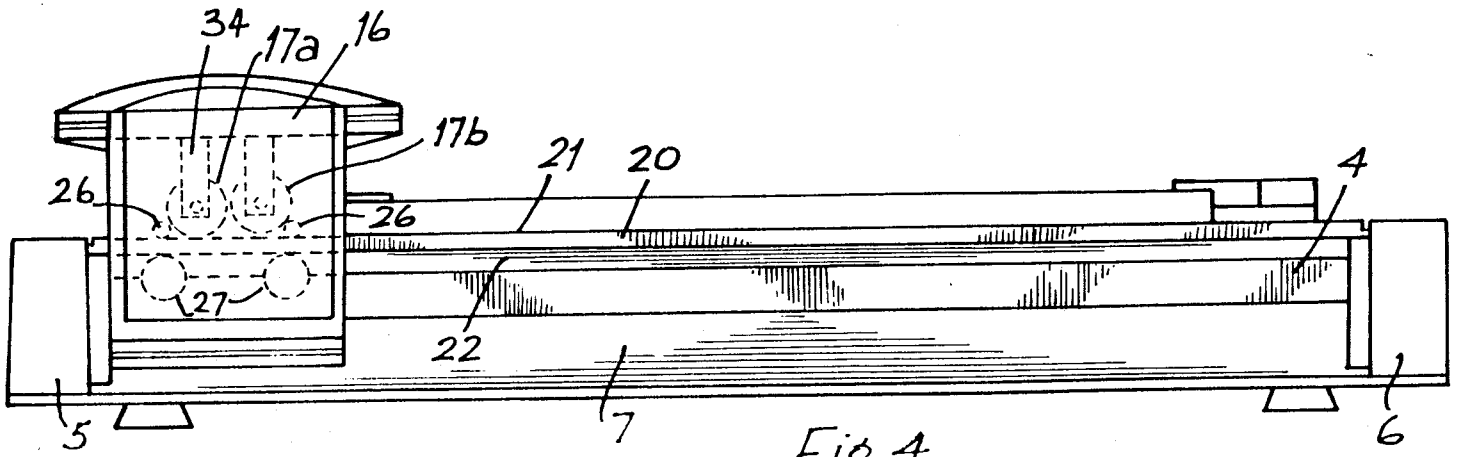
FIG. 4 is a side elevational view of the imprinter of FIG. 1 with the carriage in the position of FIG. 2.
Figure 6:
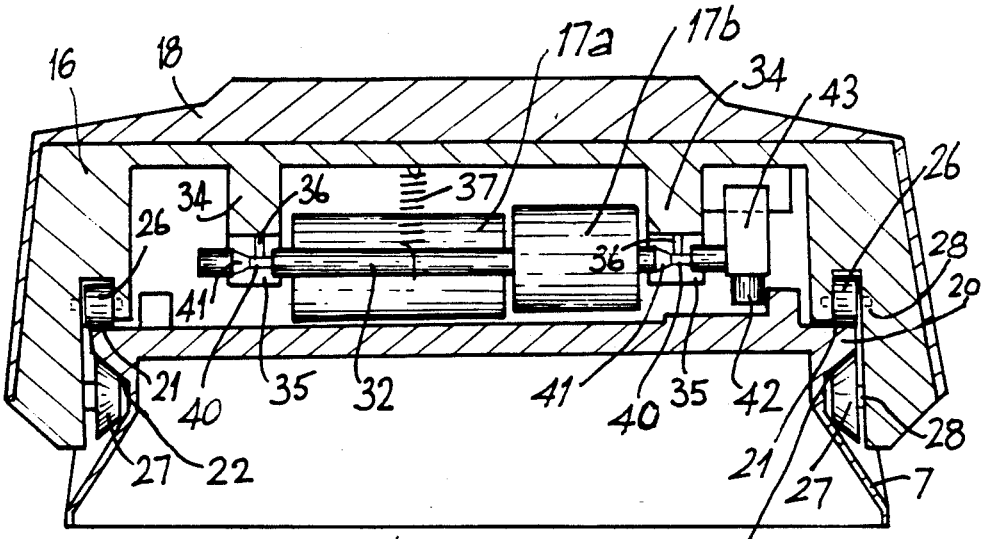
FIG. 6 is a sectional end view of the imprinter of FIG. 1.
Figure 7:
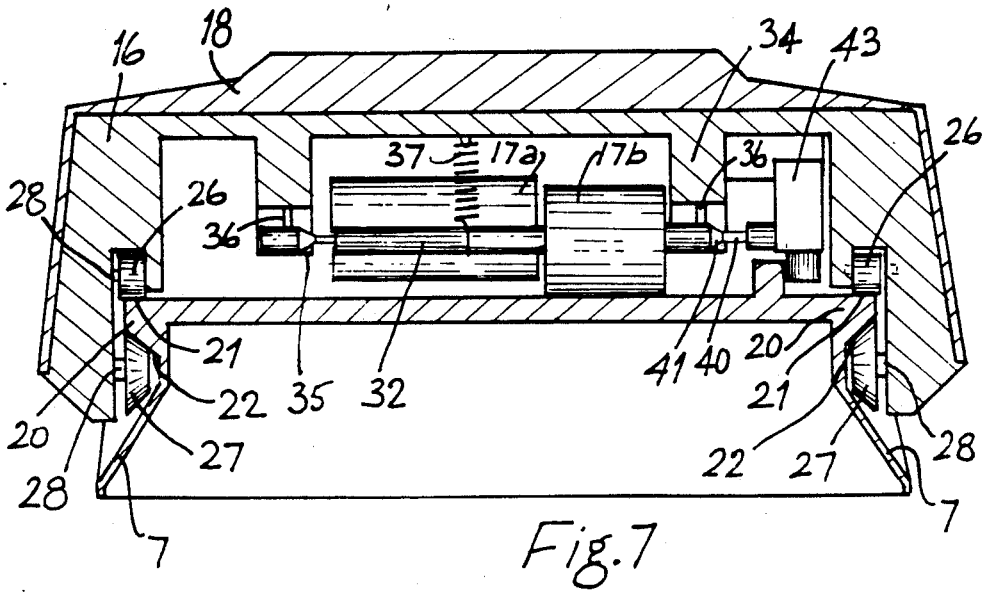
FIG. 7 is a sectional end view similar to FIG. 6 of portion of the imprinter in a different position.
Figure 8:
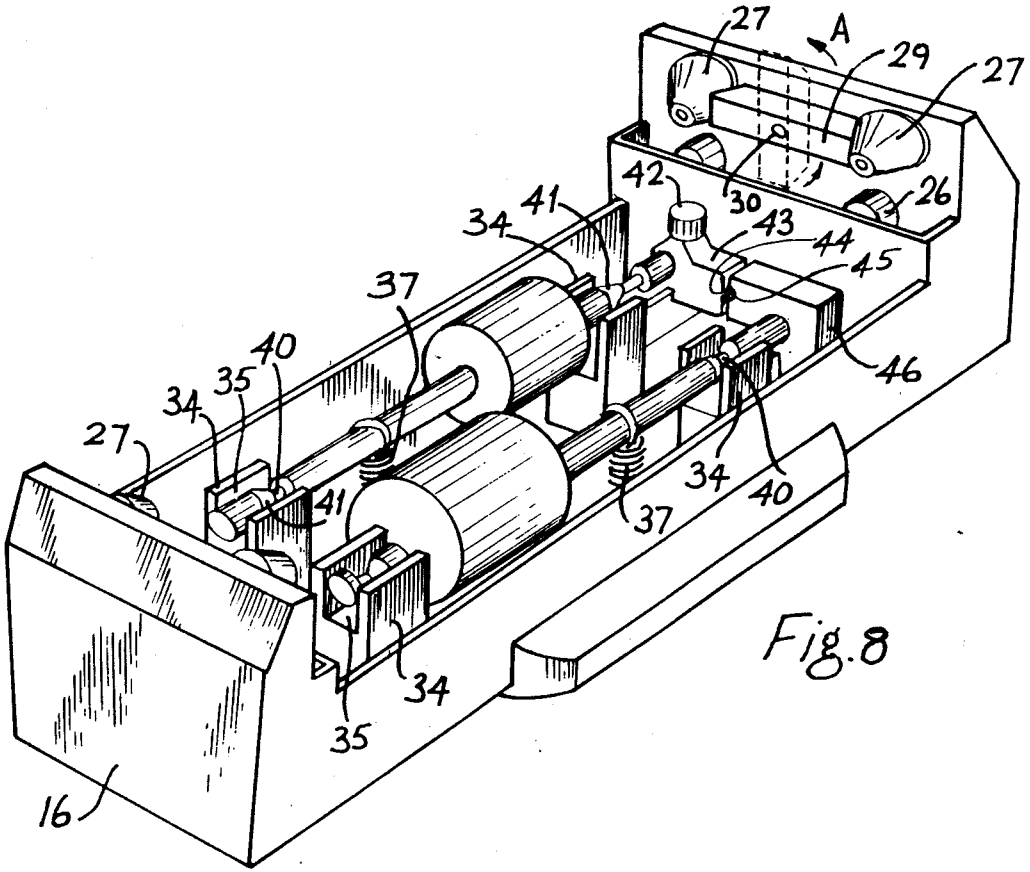
FIG. 8 is a perspective view of the carrier of the imprinter of FIG. 1 in an inverted position.
Figure 10:
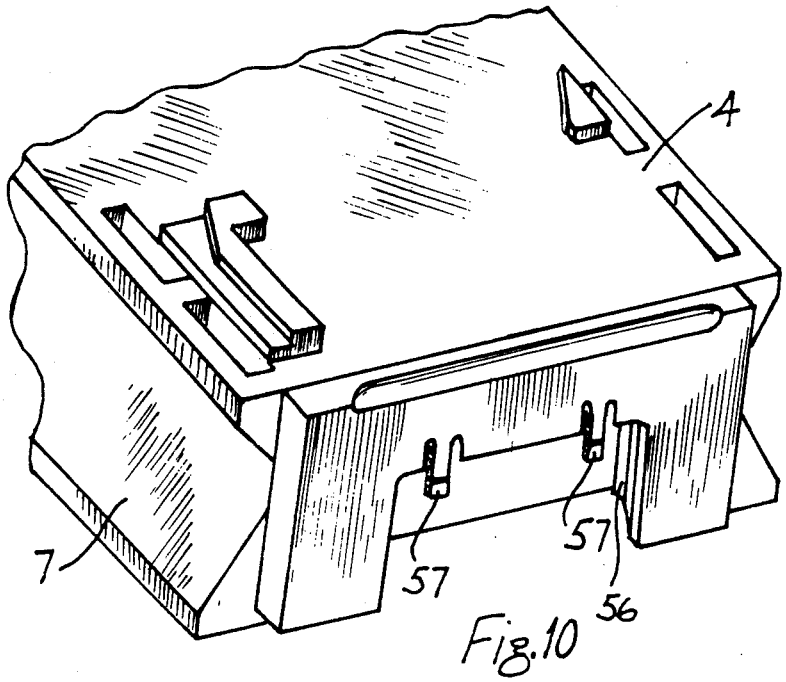
FIG. 10 is a fragmentary perspective view of portion of the detail of FIG. 9.
Figure 9:
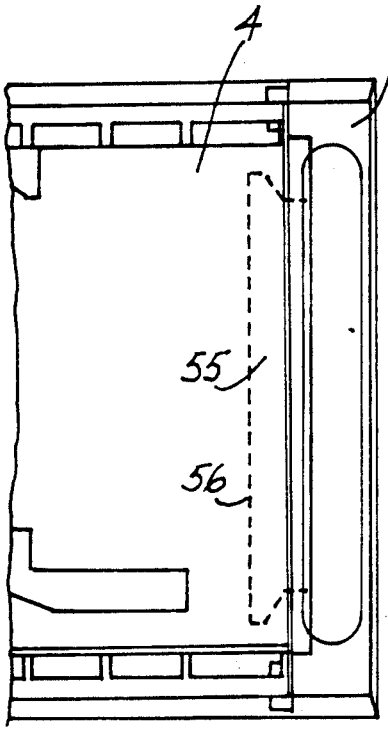
FIG. 9 is a fragmentary plan view of a detail of the imprinter of FIG. 1.

A carrier 16 with imprinter means which in this case is provided by a pair of imprinter rollers 17*a* and 17*b*, transversely spans the base 4 and is longitudinally slidably movable over the document supporting panel 10 as illustrated in FIGS. 1, 2 and 4 to a reversing return position at the other end of the panel 10 as illustrated in FIGS. 3 and 5 and back to the start position to imprint the characters on the credit card 2, the merchant's plate 14 and dating mechanism, onto the document 3. The carrier 16 comprises a housing of injection molded plastic material which is covered by a thin cover 18 also of injection molded plastic material.

Track means comprising a pair of track members 20 at opposite sides of the base 4 longitudinally spanning the length of the base 4 for guiding the carrier member 16 during its movement. The track members 20 are of plastics material and are integrally molded with the document receiving panel 10. Each track member 20 comprise opposite outwardly directed track faces, namely an upper track face 21 which in this case is substantially flat, and a lower track face 22 which is inclined at an angle to the upper track face 21.

The carrier 16 includes a pair of spaced-apart bearing means which engage the opposing track faces 21, 22 of the track members 20 with a pinch action embracing the track members 20 therebetween. In this case there are four pairs of bearing means, two pair for each of the track members 20. Each bearing means in this case comprises at least one, and in this case two pairs of pinch rollers, each pair of rollers comprising an upper pinch roller 26 which is of cylindrical shape and engages the upper face 21 of the track 20 and a lower pinch roller 27 which is of tapered shape and engages the lower face 22 of the track 20.

The pinch rollers 26, 27 are rotatable on shafts 28 which are secured in the sides of the carrier 16 by a press fit action. The ends of the shafts 28 are barbed or knurled for secure fitting. The tapered pinch rollers 27 are removable from the shafts 28 to accommodate spacer washers (no shown) mounted behind the rollers 27 for altering the gripping pressure with which the pinch rollers 26, 27 grip the track 20. A retaining member 29 is releasably mounted on the carrier 16 to retain and accommodate removal of the tapered rollers 27. Each retaining member 29 in this case comprises a pin 30 which engages a corresponding hole (not shown) in the carrier member 16 with a type of bayonet action. Thus, by rotating the retaining member 29 in the direction of the arrows A of FIG. 8 the retaining member 29 may be removed to remove the tapered rollers 27.

The imprinter rollers 17*a* and *b* are rotatable on stepped diameter shafts 31 and 32 respectively which are mounted in the carrier 16 so that they may be moved towards and away from the base 4 in use, so that the rollers 17*a*, 17*b* may alternatively print one on the outward travel stroke, and the other on the return travel stroke. The direction of the outward travel stroke is indicated by the direction of the arrow B in FIG. 2, while the return stroke is indicated by the arrow C, also of FIG. 2. The shafts 31 and 32 are mounted in support members 34, also molded integrally with the carrier 16. Each member 34 has an open ended slot 35 to engage the shafts 31 and 32. A pin 36 in the base of each slot 35 is provided to bear on the shafts 31 and 32, see FIGS. 6 and 7. Springs 37 bias the shafts 31 and 32 against the pins 36 in the slots 35. The shafts 31 and 32 are provided with stepped diameters at 40 adjacent the support members 34 and the larger and smaller diameter portions of the shafts are joined by a tapered portion 41. Thus, on sliding the shafts axially through the slots 35, the height at which the rollers 17*a* and *b* are set above the base 4, is varied. When the pins 36 bear on the larger diameter of the shafts 31 and 32, the rollers are pressed downwardly against the base 4; however, when the pins bear on the smaller diameter of the shafts 31 and 32, the rollers are retracted back up from the base 4.

Means for raising and lowering the rollers 17 by moving the shafts 31 and 32 axially, are provided in this case by a single cam follower 42 extending from a cam follower block member 43. The cam follower block 43 includes a sidewardly projecting tongue 44 which engages in a complementary shaped channel groove 45 provided in a second cam follower block 46 to facilitate movement between the blocks 43, 46. The cam follower 42 engages a single cam provided by a cam surface 47 on a cam block 48 integrally molded with the base 4. It will be apparent that the cam surface 47 is provided in the line of travel of the carrier 16, and when the cam follower 42 engages the surface 47 both cam follower blocks 43, 46 are moved thereby causing the rollers 17*a*, 17*b* to alter their positions substantially simultaneously. By virtue of the fact that a single cam surface and cam follower is provided, the full height of the cam may be used so that the minimum available height is used by the cam. It is particularly important to reduce the height of the cam to a minimum as there is only a relatively small fixed height available for printing.

A second cam block 49 with a case surface 50 is molded integrally with the vase and acts on the cam follower 42 to return the shafts 31 and 32, and in turn the rollers 17*a*, 17*b* to their reset position for printing the next transaction.

Figure 11:
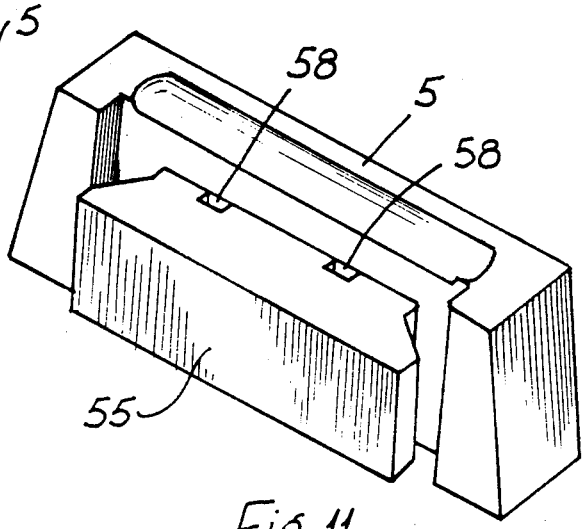
FIG. 11 is a perspective view of another portion of the detail of FIG. 9.

Returning now to the base 4 and the handles 5 and 6, as already mentioned, the handle 6 is molded integrally with the base 4. However, the handle 5 is removable to open one end of each of the tracks 20 so that the carrier may be removed for any repairs or adjustments which may have to be carried out. For example, should it be necessary to removed or replace an imprinter rollers or to vary the pressure of the pinch rollers 17*a*, 17*b* on the tracks 20 by the addition or removal of washers (not shown) on the shafts 28 of the tapered rollers 27. FIG. 11 illustrates the handle 5 and as can be seen, a dovetail projection 55 is provided which slidably engages corresponding dovetail slot 56 in the base 4. Further spring clips 57 on the base 4 engage the handle 5 through slots 58, thus locking the handle 5 firmly in position. To remove the handle, the handle 5 is slid downwardly of the base 4 and removed. It will be appreciated that any suitable joint may be employed between the handle 5 and the base 4 to facilitate ease of removal.

In use, the credit card 2 is positioned in the credit card receiving area 8, and the document 3 is placed on the document supporting panel 10. The carrier 16 is then moved over the base in the direction of the arrow B with the roller 17*b* in the down position to imprint the embossed characters on the credit card 2 on the document 3, and the roller 17*a* in the up position, thus clearing the data on the merchant's plate 14 and the date. When the carrier 16 has moved to the full extent of its travel outwardly in the direction of the arrows B and is in the reversing return position illustrated in FIG. 3, the cam follower 42 on engaging the cam surface 47, slides the shafts 31 and 32 axially, thereby raising the roller 17*b* and lower the roller 17*a* to imprint the characters on the merchant's plate 14 and the date mechanism on the document 3 on the return stroke C. On returning to the position illustrated in FIG. 2, the cam follower 42 on engaging the cam surface 50 axially slides the shafts 31 and 32 so that the rollers 17*a*, 17*b* are again in position to print on the outward stroke for the next transaction.

Figure 12:
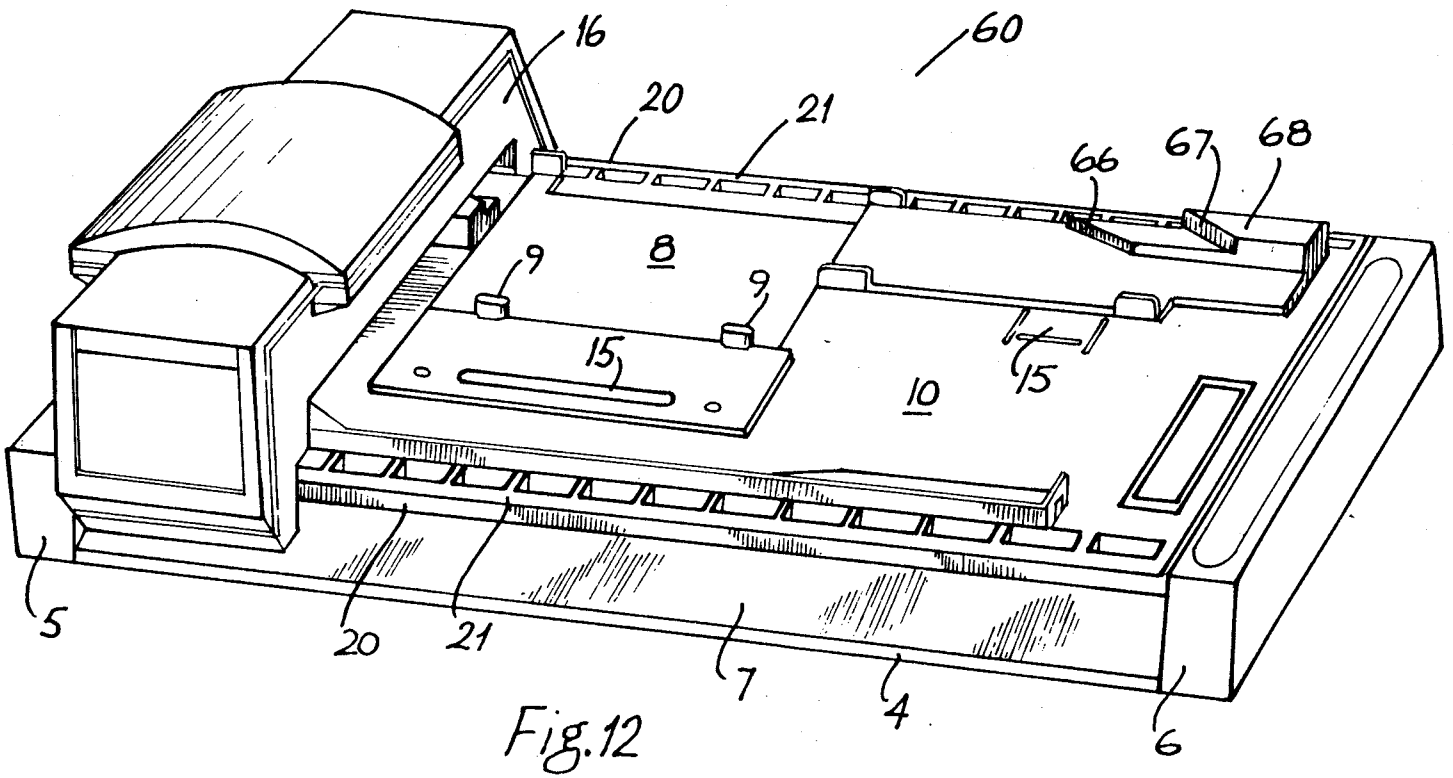
FIG. 12 is a perspective view of an imprinter according to another embodiment of the invention.
Figure 13:
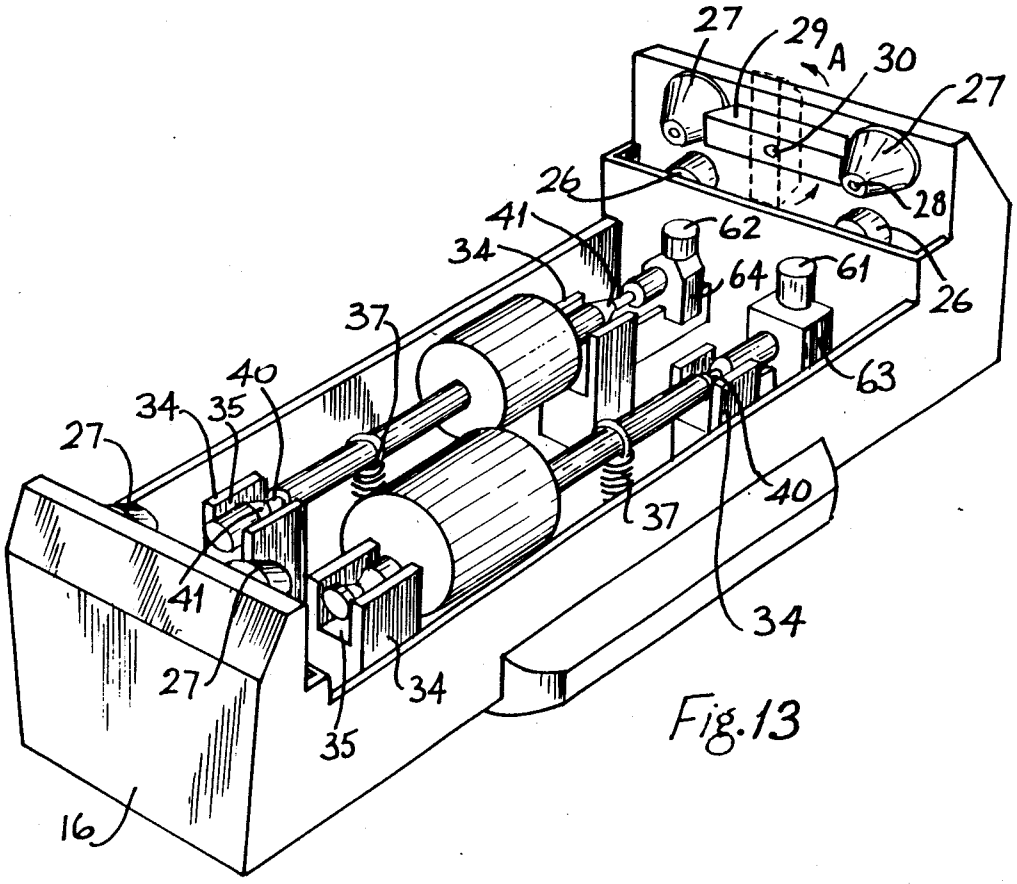
FIG. 13 is a perspective view of portion of the imprinter of FIG. 12.

Referring to FIGS. 12 and 13, there is illustrated imprinter apparatus according to another embodiment of the invention, indicated generally by the reference numeral 60. The imprinter apparatus 60 is of similar construction to the apparatus described above with reference to FIGS. 1 to 11 and like parts are assigned the same reference numerals. In this case, means for raising and lowering the rollers 17*a* and 17*b* by moving the shafts 31 and 32 axially, are provided by a pair of cam followers 61, 62 which extend upwardly from a pair of cam follower blocks 63, 64 respectively. The cam followers 61, 62 engage cams provided by a pair of upwardly extending cam surfaces 66, 67 on a cam block 68 integrally molded with the base 4. As will be apparent from FIG. 12 the cam surfaces 66, 67 are provided in the line of travel of the carrier, and the surface 66 is arranged before the surface 67. The spacing between the two surfaces is substantially similar to the spacing between the cam followers 61 and 62, thus both cam 61, 62 followers engage the surfaces 66, 67 at substantially the same time, thereby causing the rollers 17*a*, 17*b* to alter their positions substantially simultaneously. By virtue of the fact that two cam surfaces are provided, the length of travel which the carrier would otherwise have to travel, is shortened. Thus, a shorter base may be provided.

Referring to FIGS. 14 to 16, there is illustrated an alternative construction of carrier 70 similar to the carrier described above with particular reference to FIGS. 12 and 13 and like parts are assigned the same reference numerals. In this case a self compensating retaining member 71 is provided for the lower pinch roller 27. The self compensating member 71 comprises a pair of wedges 72 each having an elongated slot 73 in which the shafts 28 of the tapered rollers 27 are mounted. The wedges 72 are linked by a leaf spring 74 which urges the wedges against the back of the rollers 27 to alter the gripping pressure with which the pinch rollers grip the track 20. The member 71 essentially provides a self compensating member to take up any wear on the rollers.

It will be appreciated that the gripping pressure of the pinch rollers on the tracks 20 may be set by any suitable means. For example, by means of an eccentric shaft moving the roller shaft upwardly and downwardly as required.

It will be appreciated that while a particular shape and construction of apparatus has been described, the apparatus could be of any other desirable shape and construction. Further, it will be appreciated that while one of the handles has been described as being removably mounted to the base, both handles of desired could be removably mounted. Further, it is envisaged in certain cases that neither handles may be removable mounted. It is also envisaged that where on or both handles are to be removably mounted, other suitable means for releasably mounting them may be provided.

Further, it will be appreciated that any other arrangement or construction of receiving areas for the card and document could be provided. Similarly, other suitable cams and camming surfaces and cam followers could be provided besides those described.

Further, it will be appreciated that other suitable supports means for supporting the shafts of the imprinter rollers could be provided, and other suitable means for raising and lowering the rollers could similarly be used without departing from the scope of the invention. It will also of course be appreciated that other shapes and constructions of track could be provided, and similarly, other suitable shapes and construction of pinch rollers or pinch bearing means could be provided.

Further, it will be appreciated that while the apparatus has been described for imprinting characters embossed on a credit card onto a docket, the device could be used for any form of printing or imprinting.

We claim:

1. In a hand operated imprinter for imprinting characters from a card-like character source member such as a credit card or the like onto a sheet material document, comprising an elongated generally rectangular base member having a flat upwardly facing panel forming a document supporting surface, a reciprocative carrier member transversely spanning the base member supporting imprinter roller means and movable longitudinally over the document supporting panel from a start position adjacent one end of the panel to a reversing return position adjacent the other end of the panel, the carrier member having opposite side portions flanking opposite sides of the base member, said imprinting roller means comprising at least one imprint roller for engaging a document when positioned on said panel overlying said character source member during movement of said carrier member between said start and return positions, the base member and carrier member having coactive means for moving the imprint roller from a raised inactive position to an imprint position engaging the document to cause imprinting of characters on said source member onto the document during such last-mentioned movement of the carrier member; the improvement comprising said base member having track means at said opposite sides of the base member longitudinally spanning the length of the base member for movably supporting and guiding the carrier member during its movement, said track means at each of the opposite sides comprising an upwardly facing first track surface disposed in substantially a horizontal plane paralleling said panel and an inclined downwardly and outwardly facing second track surface formed by an upper side face of an outwardly opening track channel at each opposite side of the base member having outwardly diverging upper and lower side faces, the portion of said base member at each side thereof lying between said first and second track surfaces defining a truncated triangular rib formation, and said carrier member having a pair of pinched action bearing roller assemblies at the respective opposite side portions thereof each comprising an upper roller having a cylindrical periphery concentric with a horizontal axis of rotation thereof disposed in confronting downwardly bearing rolling relation to said upwardly facing first track surface adjacent thereto and a tapered inwardly convergent substantially conical companion lower roller spaced directly below the upper roller and bearing upwardly in confronting rolling relation against said upper side face of the adjacent track channel, said upper roller and companion lower roller at each side of the carrier member being spaced so as to exert a vertically directed converging pinch action on and embracing said truncated triangular rib formation at the adjacent side of the base member.

2. An imprinter as defined in claim 1, wherein said track means are a pair of elongated track members positioned respectively at said opposite sides of the base member and having opposite outwardly directed track faces shaped to define outwardly opening and outwardly diverging truncated v shaped track channels, the lower side face of each track channel defining a lower side face confronting said upper side face and inclined relative to said horizontal plane to subtend a larger angle therewith than the angle subtended by said upper side face.

3. An imprinter as defined in claim I, wherein the portions of said base member forming said document supporting panel and said track members are an integral plastic body having the track means formed therein.

4. An imprinter as defined in claim 2, wherein the portions of said base member forming said document supporting panel and said track members are an integral plastic body having the track means formed therein.

5. An imprinter as defined in claim 1, wherein said imprint roller is mounted on a stepped diameter shaft coactive with shaped cavity surfaces in shaft support members of the carrier member in which the shaft is slidable axially to raise and lower said imprint roller between print and non-print positions for causing the imprint roller to print in one direction of travel only of the carrier member.

6. An imprinter as defined in claim 2, wherein said imprint roller is mounted on a stepped diameter shaft coactive with shaped cavity surfaces in shaft support members of the carrier member in which the shaft is slidable axially to raise and lower said imprint roller between print and non-print positions for causing the imprint roller to print in one direction of travel only of the carrier member.

7. An imprinter as defined in claim 1, wherein said roller means comprises two imprint rollers for selectively engaging the document, one of the rollers engaging the document during movement of the carrier in one direction and the other roller engaging the document during movement of the carrier member in the other direction, said imprint rollers being mounted respectively on a pair of stepped diameter shafts coactive with shaped cavity surfaces in shaft support members of the carrier member in which the shafts are slidable axially to raise and lower said imprint rollers between print and non-print positions causing one of the rollers to print in one direction of travel and the other roller to print, in the other direction of travel.

8. An imprinter as defined in claim 2, wherein said roller means comprises two imprint rollers for selectively engaging the document, one of the rollers engaging the document during movement of the carrier in one direction and the other roller engaging the document during movement of the carrier member in the other direction, said imprint rollers being mounted respectively on a pair of stepped diameter shafts coactive with shaped cavity surfaces in shaft support members of the carrier member in which the shafts are slidable axially to raise and lower said imprint rollers between print and non-print positions causing one of the rollers to print in one direction of travel and the other roller to print in the other direction of travel.

* * * * *